United States Patent [19]

Bassompierre-Sewrin

[11] 4,294,869

[45] Oct. 13, 1981

[54] METHOD FOR COATING PIPELINE

[75] Inventor: Christian C. Bassompierre-Sewrin, Embrun, France

[73] Assignee: Martech International, Inc., Houston, Tex.

[21] Appl. No.: 79,181

[22] Filed: Sep. 26, 1979

[51] Int. Cl.[3] ..... B05D 3/12

[52] U.S. Cl. ..... 427/177; 427/232; 427/234; 427/178; 427/231; 118/105; 118/DIG. 10; 118/408

[58] Field of Search ..... 427/238, 177, 178, 231, 427/234, 232; 118/DIG. 10, 105, 408

[56] References Cited

U.S. PATENT DOCUMENTS 1,796,338 3/1931 Moore ..... 118/DIG. 10

3,108,012 10/1963 Curtis ..... 118/105

FOREIGN PATENT DOCUMENTS 46-8107 of 1971 Japan ..... 427/231

*Primary Examiner*—Sam Silverberg

*Attorney, Agent, or Firm*—Bernard A. Reiter

[57] ABSTRACT

A method of coating a pipeline comprising the steps of: Welding joints of pipe, end to end to form a continuous pipeline having an entry end and an exit end, winding said pipeline onto a reel, and coating the interior thereof by inserting a pig into the pipeline at one end thereof and affixing a cap at the other end thereof, introducing a coating liquid into the pipeline on the reel, and rotating the pipeline while the pig is maintained in a relatively static position so that the pig smoothly and evenly coats the pipeline as it rotates.

17 Claims, 6 Drawing Figures

METHOD FOR COATING PIPELINE

BACKGROUND OF THE INVENTION

This invention concerns an improvement in a method for coating the interior of a pipe. More particularly, the invention is directed to a method for coating the interior of elongate pipelines to protect them against corrosion.

A number of problems are commonly experienced when coating the interior of the pipeline. For example, the utilization of pigs for coating the interior of a pipeline frequently results in an air pocket which prevents a portion of the interior from receiving a coating thereon. The elimination of air pockets, particularly at the upper level of the interior surface, is difficult because of inherent gravitational flow of the paint downward while the inherent movement of the air pocket is upward. Similarly, the accomplishment of an evenly distributed interior coating is difficult because of the inherent downward gravitational flow of the paint toward the bottom of the interior pipe surface.

SUMMARY OF THE INVENTION

It is an object of this invention to provide a method for coating the interior of a pipeline.

It is another object of the invention to provide a method for coating the interior of a pipeline, after the pipe joints are assembled, but before the pipeline is placed in its operational location.

It is another object and advantage of this invention to provide a coating on the interior of a pipeline without having to move the coating equipment, material and manpower from a single location.

It is still a further object and advantage of the invention to provide a relatively inexpensive method for coating the interior of an elongate pipeline through the use of a pig.

It is yet another feature and advantage of the present invention to coat the interior of a pipeline evenly and reliably over the entire surface thereof by using the inherent gravitational forces of the environment.

It is still another feature and advantage of the invention to provide an economic and reliable method for coating the interior of a pipeline evenly over the surface thereof and while eliminating the possibility of air pockets.

Numerous other features of the invention will become apparent from the following description, claims and drawings, wherein like numerals denote like parts in the several views, and wherein:

DESCRIPTION OF THE PREFERRED EMBODIMENTS

This application is a continuation-in-part of the earlier filed application, Ser. No. 957,218, entitled "Method For Coating Pipeline", filed Dec. 7, 1978 now abandoned.

Figure 1:
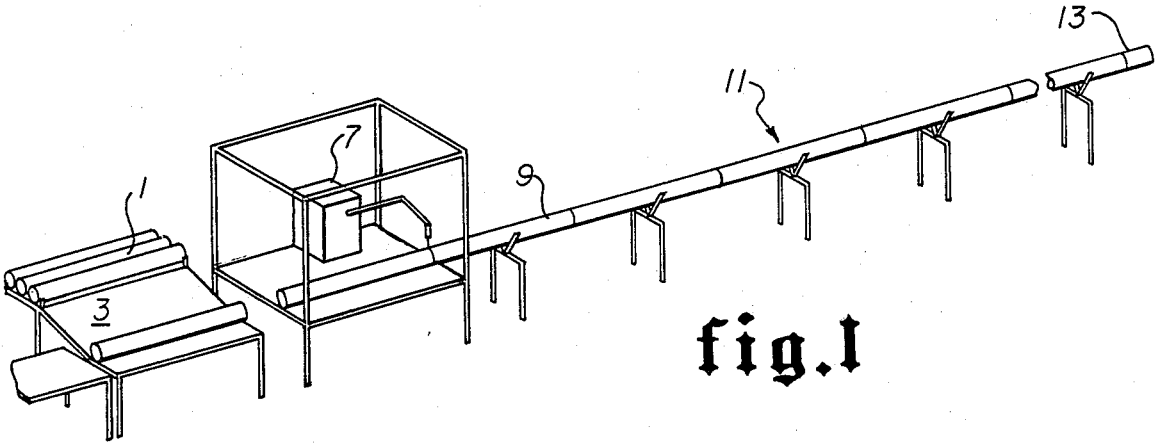
FIG. 1 illustrates a pipe assembly yard wherein individual straight pipe joints are welded together to form a pipeline.

Referring now to FIG. 1, there is shown, in illustrative manner, a pipe assembly yard in which individual, elongate joints 1 of pipe are maintained in storage in typical rack like fashion for individual retrieval down the ramp 3 onto a moving conveyor 5 that carries each pipe joint 1 past the welding or other equipment 7 where the pipe joint is placed in abutting position with the previous pipe joint 9 so that the two pipe joints may be fused together. This basic sequence of fusing adjacent pipe joints together, such as by welding, may be carried out in this manner, or in any desired manner so as to form the elongate pipeline 11. The pipeline 11, in accordance with the principles of the invention, is fabricated to a predetermined desired length of up to thousands of feet or more. After an initial length of pipeline 11 has been fabricated, tne end 13 thereof is appropriately fixed to the spool 15 of an adjacent reel 17 (see FIGS. II and III) disposed at a predetermined distance from the end of the conveyor 5. As the pipe joints 1 are fused to one another and the length of the pipeline thereby increased, the reel 17 is caused to rotate in order to lay the pipeline down the length of the spool to form a first layer of pipe thereon and thereafter over the first layer, down the length of the spool to form a second layer thereon, this being repeated until the reel is "loaded" with pipeline comprising a series of layers or "wraps" of pipeline. It is understood that the reel 17 may be loaded with pipeline by this or other procedures such as winding individual lengths of pipeline comprised each of multiple fused joints and welding these length together each, as they are loaded onto the reel. It is essential only that the predetermined length of uninterrupted pipeline ultimately be loaded onto the reel for the purpose of coating it in position thereon. It will thus be recognized that the entire pipeline, of predetermined length, is thus prepared and disposed in a singular location at which such entire pipeline may be subjected to the subsequent step of applying an interior coating thereto for preventing and/or inhibiting corrosion, without having to move equipment, materials or manpower along the length thereof during the coating procedure.

Figure 2:
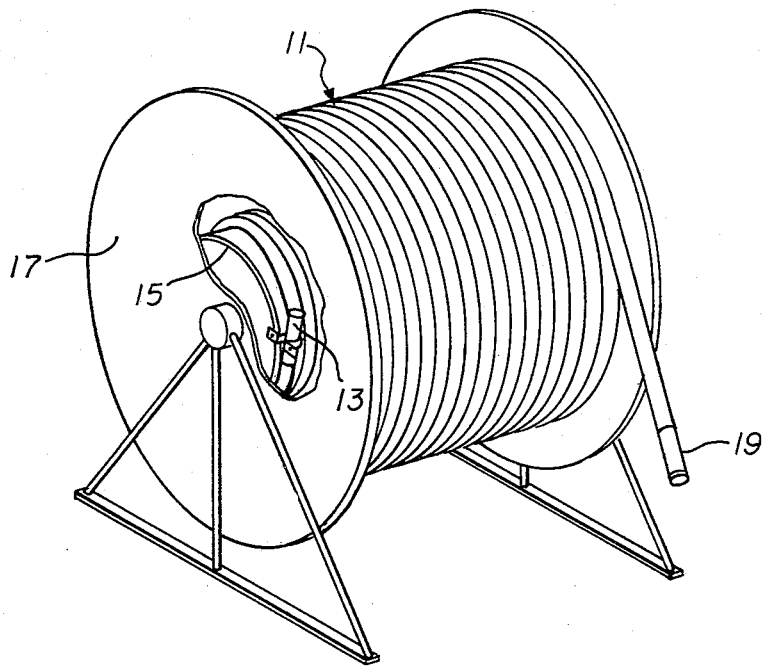
FIG. 2 is an elongate pipeline wrapped upon a reel in preparation for coating in accordance with the principles of the invention.
Figure 3A:
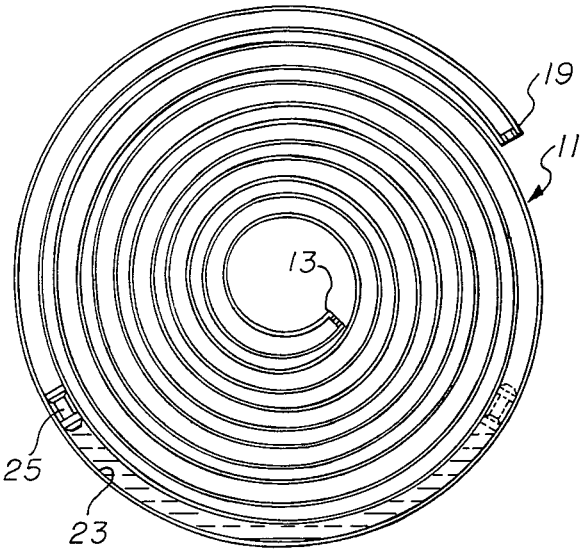
FIG. 3*a* is a side view showing the position of a pig in the pipeline in accordance with the principles of the invention.
Figure 3B:
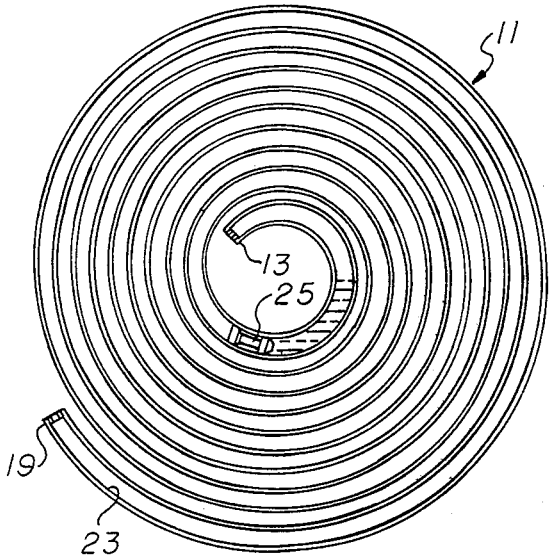
FIG. 3*b* is a side view of a pipeline in accordance with the principles of the invention showing the pig in a second position.
Figure 4:
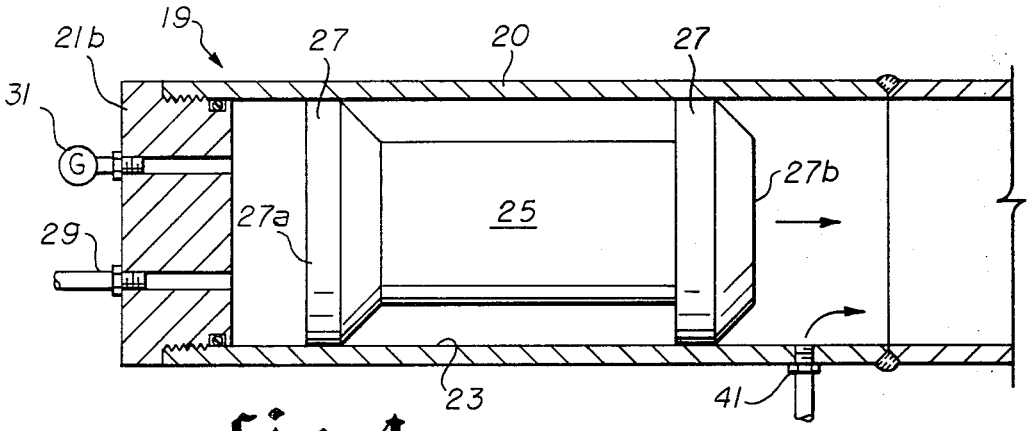
FIG. 4 is a cross-sectional view of the pipeline of FIG. 2 at one end thereof.
Figure 5:
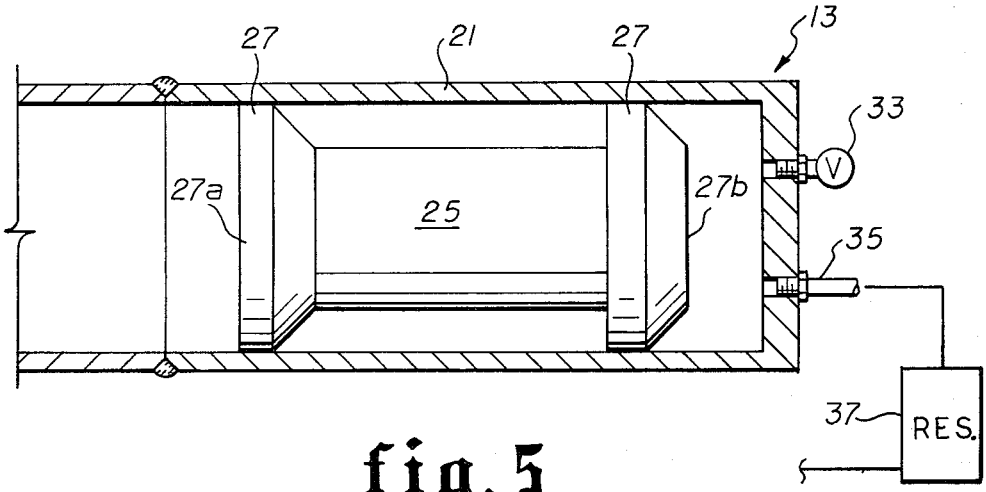
FIG. 5 is a cross-sectional view of the pipeline of FIG. 2 at the other end thereof.

With reference now to FIGS. 2, 3*a* and 3*b*, there is shown the pipline 11 disposed on its reel 17. The pipeline is characterized by the ends 13 and 19, which for purposes of illustration hereafter, shall be referred to as the entry end 19 and the exit end 13. The reel is rotated to a position such that exit end is made relatively accessible, and such that it is positioned at a point above the liquid level in the pipeline, as described hereinafter. Thereafter, a metal housing having cap 21(*a*) is fixedly attached to the exit end 13 of the pipeline such as by welding or bolt connections, see FIG. 5. The other end, that is the entry end, is to be enclosed by housing 20. Housing 20 comprises an end cap 21(*b*) and wall 23. Positioned within the housing is a pig means 25. The pig means 25 is characterized by cups 27 of appropriate diameter and material for sliding movement along the interior of the pipeline for the purpose of deploying a thin coating of material on the inner wall as the pig means moves therealong. Therefore, the diameter of the cups are sufficiently less than the internal diameter of the pipe so as to produce a residual film substantially the thickness of the difference between the two diameters. The pig is positioned within the metal housing 20, as shown in the drawings, and the housing is then welded, bolted or otherwise affixed to that end of the pipeline.

Each of the heads caps 21(*a*) and 21(*b*) are characterized by a plurality of openings extending therethrough from the exterior to the interior of the housing. At the entry end 19, the cap 21(*b*) is characterized by an opening for receiving the pressure hose 29 which is adapted to supply fluid pressure to that volume of the pipeline interior defined by the inner surface of cap 21(*b*), the rear face 27(*a*) of the pig 25, and the interior surface of the pipeline. Also, a pressure gauge 31 resides in another opening within the cap 21(*b*) so that the fluid pressure thereat may be monitored and maintained at a sufficient level to produce the desired movement of the pig 25 along the pipeline.

The openings in cap 21(*a*) may comprise a vent 33 extending through the cap from the interior of the pipeline to the exterior thereof for the purpose of relieving pressure in the pipeline produced as a result of movement of the pig 25 from the entry end 19 to the exit end 13. A second opening is provided in the form of the exit means 35 through which excess coating is adapted to traverse into a reservoir tank 37 or, if desired, instead to the original supply tank which feeds coating liquid, or the like, into the pipeline, see FIG. 5.

Once the housing 20 is affixed in place, the end of the coating hose 41 is coupled to the side port thereof adjacent to front face 27(*b*) of pig 25. Actually, the hose can be connected at substantially any optimal point along the pipeline residing between the face 27(*b*) and the exit end 13. The coating hose is coupled to a supply tank of coating material and a predetermined amount of such coating material is thereafter pumped into the pipeline 11 so as to fill the bottom portion of the pipeline with such coating material 12, as is indicated in FIGS. 3*a* and 3*b*. The coating liquid moves to the bottom areas of the reeled pipeline due to gravitational forces, see FIGS. 3*a* and 3*b*. The coating material is generally intended to resist corrosion and is to be applied to the surface of the interior walls of the pipeline in such a manner as to be evenly distributed thereon and in accordance with the method herein whereby the coating stays evenly distributed by reason of rotational movement of the reel as the coating step takes place. Also, due to the inherent distributional characteristics of the moving reel on the liquid coating, the possible existence of air pockets is eliminated. The coating material is generally intended to resist corrosion and is to be applied to the surface of the interior walls of the pipeline in accordance with the steps outlined hereinafter. Such material may consist of a liquid chemical, such as epoxy, or nylon, or coal tar, or other hydrocarbon or plastic, the particular material being determined, in part, by the type of liquid or gas which the pipeline is intended to transport. The amount of coating material introduced to the pipeline is calculated by determining the volume of the pipeline and introducing a sufficient amount therein to ensure the complete coating of the wall surface thereof and at the required thickness as is determined by the difference between the diameter of the faces of pig 25 and the interior diameter of the pipeline.

In operation, after the pipeline has been reeled for coating the housing 20 having a pig, or other plug means therein is installed. The similar housing having end cap 21(*a*) is affixed and the coating hose 41 and pressure hose 29 is connected. The necessary gauges and vent means 31, 33 are actuated and the coating material is pumped into the pipeline 11 through the hose until the necessary predetermined quantity is deposited therein. This predetermined quantity of liquid coating material will gravitate to the bottom portion of the reeled pipeline and seek a level 28. Pressure is built up in the pipeline to a level necessary to induce forward movement of the pig, with the operator, monitoring the internal pressure on gauge 31 as the pig begins to move. Initial positioning and movement of the pig is indicated in FIG. 3*a*. As the pig initiates movement from such position, the operator initiates rotational movement of the pipeline 11 by movement of the reel 17 in the counter-clockwise direction. The rate of movement of the reel 17 is coordinated with the pressure on pig 25 so that pig 25 is maintained in a relatively static position with respect to the axis of the reel. Thus, it will be recognized that although the pig is moving through the pipeline, its relative position with respect to all other static bodies is not changing but for the fact that the pig is, of course, moving radially inward toward the axis of the reel as it progresses through each lap of the pipeline while the reel rotates. Its movement toward the axis of the reel therefore is essentially along a radial extending outwardly from the axis. As is illustrated in FIG. 3*b*, the pig 25 has, after a plurality of rotations of the reel moved inwardly toward the axis of the reel. It will thus be further recognized that as the pig is caused to move through the pipeline in this manner, a number of occurrences takes place. First, the liquid coating in the pipeline is caused to move, by the force of gravitation, throughout the interior surface of the pipeline thus filling and coating it as the reel rotates. The opportunity for air pockets to occur on a surface portion of the pipeline is eliminated when the pipeline "rolls" because the air pocket itself necessarily moves to a continuingly different position than it was in prior to movement of the pipeline. In other words, the "air bubble" is caused to move throughout the pipeline, and as this occurs, liquid coating covers the previous position of the air bubble. As the pipeline "rolls" by movement of the reel, the pig follows its predestined path through the pipeline causing the liquid to be evenly distributed over the interior surface thereof. As indicated above, the pig maintains essentially the same relative position with respect to the axis of the reel but for its continuingly inward radial movement. Since the pipeline is rotated throughout the coating procedure, there is no opportunity for the liquid coating to accumulate at one position on the interior of the pipeline more so than at another position on the interior of the pipeline. In other words, the liquid coating does not gravitate toward the interior floor of the pipe, because the pipeline is caused to move rotationally such that the "floor" of the pipeline becomes the "ceiling" of the pipeline after movement of 180 degrees. A segment of pipeline which has been coated and which is positioned at 180 degrees on a lap exterior of the lap containing the pig 25 will, after movement of another 180 degrees, have its "floor" segment in a "ceiling" position and liquid coating that may have gravitated down the side walls to the floor will be subjected to the same force of gravity, and such liquid coating will be caused to gravitate back to its original position. Therefore, an even distribution of liquid coating on the interior walls of the pipeline is inherently accomplished. It will further be recognized that gravitational forces are herein used to move the liquid coating through the length of the pipeline, and that the pig 25 is used principally to evenly distribute the liquid coating over the interior surface thereof. After the pig has traversed a given segment of the pipeline, the inherent gravitational forces maintain an even and consistent thickness of liquid coating as the pipeline rotates on the reel. The pot life of the liquid coating maintains a necessarily sufficient viscosity while the reel is rotating during the coating method. After the pipeline has been completely coated, it may be advisable to continue rotation of the pipeline until the paint is no longer sufficiently viscous on the interior walls to allow gravitational flow. At such time, the rotation is stopped and the plug means 25 and pig removed. It will be recognized that pressure in the pipeline may require venting such as through purge means 33. Upon completion of the coating method, the ancillary equipment, including the pig and the like, is removed and the pipe coating is allowed to completely set.

While this invention has been described in connection with certain specific embodiments, it will be obvious to those skilled in the art that various changes may be made in the form, structure, arrangement of components and the respective sequence of the steps set forth without departing from the spirit and scope of the invention. For example, it is deemed within the purview hereof to insert the pig either at the end of the pipeline remote from the axis and rotate the pipeline, as disposed in FIG. 3*a*, counter-clockwise, or in the alternative, the pig may be disposed proximate the interior of the pipeline reel adjacent the axis and the pipeline may be rotated in a clock-wise fashion. Likewise, the pig can be disposed in operation, at any of a number of static positions, although it will be recognized that there may be advantage in maintaining the pig at or near the 90 degree or 270 degree position due to use of the weight of the pig in order to optimally facilitate movement through the pipeline at these respective positions. Such alternative modes of operation as mentioned for exemplary purposes here should be understood to come within the spirit of the invention and the scope of the appended claims.

Therefore, that which is claimed and desired to be secured by United States Letters Patent is:

1. In a method for coating an elongate pipeline prior to the laying for inhibiting corrosion wear on the interior thereof comprising the steps of:

reeling the pipeline onto a spool, installing a pig into the pipeline adjacent a first end thereof and closing that end and also the second end, introducing coating material into the pipeline between the pig and the second end in sufficient quantity to coat the interior of the pipeline to a predetermined thickness, rotating the pipeline on its reel in a first direction, and introducing a sufficient air pressure into the pipeline between the pig and said first end to cause the pig to move through the pipeline in a direction opposite to the direction of rotation, thus causing the interior of the pipeline to be coated with the coating material that is caused to move therethroughout by gravitational force as the pipeline rotates, the pig moving to smooth the coated pipeline surface as it traverses the walls thereof.

2. The method of claim 1, including the additional step of venting the pipeline proximate said second end to relieve the pressure buildup therein created by movement of the pig.

3. The method of claim 2, including the additional step of providing a port proximate said second end for removing excess coating material from the interior of the pipeline as the pig moves therethrough.

4. The method of claim 3, including the step of recycling the coating material which emanates from the port to resupply further pipeline coating work.

5. The method of claim 4, including the step of monitoring the pressure magnitude in the pipeline for moving the pig relative to the pipeline but maintaining the pig substantially in the same radial emanating from the reel axis.

6. The method of coating a plurality of pipe joints used in an elongate pipeline in the interior thereof to inhibit corrosive wear during use but prior to placement of the pipeline itself comprising the steps of:

coupling the pipe joints together at their abutting ends to produce an elongate pipeline, reeling the pipeline onto a spool, installing a pig into the pipeline adjacent a first end thereof and closing that end and also the second end, introducing coating material into the pipeline between the pig and the second end in sufficient quantity to coat the interior of the pipeline to a predetermined thickness and allowing said coating materials to gravitate to the bottom portion of the pipeline, rotating the spool with the pipeline thereon so as to gravitationally move the coating material throughout the interior surface of the pipeline, and inducing movement of the pig through the pipeline as the pipeline rotates in a direction opposite to movement of the pig for providing a uniform distribution of coating material throughout the pipeline interior.

7. The method of claim 6, including the additional step of venting the pipeline proximate said second end to relieve the pressure buildup therein created by movement of the pig.

8. The method of claim 7, including the additional step of providing a port proximate said second end for removing excess coating material from the interior of the pipeline as the pig moves therethrough.

9. The method of claim 8, including the step of recycling the coating material which emanates from the port to resupply further pipeline coating work.

10. The method of claim 9, including the step of monitoring the pressure magnitude in the pipeline for moving the pig.

11. The method for coating a pipeline interior through the use of a housing means to be affixed to the pipeline adjacent the first end and having a pressure port, coating material port and pressure inlet port therein and containing a pig means adapted to be launched from said housing means into the pipeline toward the second end to spread a uniform coating thereover comprising the steps of:

reeling the pipeline onto a spool preparatory to coating of the pipeline interior, affixing a housing means containing pig means therein to one end of the pipeline, introducing coating material to the interior of the pipeline between the pig means and the second end thereof, rotating the spool with the pipeline thereon so as to move the coating material throughout the interior of the pipeline, and inducing movement of the pig through the pipeline as the pipeline rotates at a level above the level of the coating, but in a direction opposite to the rotational direction of movement of the pipeline so as to ensure a continuous and uniform coating throughout the surface of the pipeline.

12. The method of claim 11, including the step of affixing a cap means on the pipeline at the second end thereof to receive the pig means after it traverses the pipeline.

13. The method of claim 12, including the step of venting the pipeline at the second end thereof by allowing pressure and excess coating material to be expelled through the cap means.

14. The method of claim 11, including the step of maintaining the pig means in a position relative to the axis of the pipeline along a given radial therefrom.

15. The method of claim 14, including the step of maintaining the pig means at a static position with respect to the axis of the spool but along a radial therefrom.

16. The method of coating a pipeline interior comprising the steps of reeling the pipeline onto a spool placing a plug means in the pipeline proximate an end thereof, introducing coating material to the pipeline sufficient to coat the interior thereof, moving the plug means relative to the pipeline as the pipeline rotates to produce a coating layer on the wall while clearing excess coating material therefrom as it traverses the pipeline.

17. The method of claim 16, including the step of maintaining the pig means at a position proximate the 90 degree and 270 degree positions of the reeled pipeline.

* * * * *